United States Patent [19]

Koltai et al.

[11] 4,181,498

[45] Jan. 1, 1980

[54] DYEING AND PRINTING WITH SYNTHETIC THICKENERS

[75] Inventors: Paul Koltai, Binningen; Georg Robert, Riehen, both of Switzerland

[73] Assignee: Sandoz Ltd., Basel, Switzerland

[21] Appl. No.: 724,490

[22] Filed: Sep. 20, 1976

[30] Foreign Application Priority Data

Sep. 23, 1975 [CH] Switzerland ..... 12336/75
Mar. 12, 1976 [CH] Switzerland ..... 3093/76

[51] Int. Cl.[2] ..... D06P 1/39; D06M 3/10; D06P 1/653; D06P 1/673

[52] U.S. Cl. ..... 8/18 A; 8/1 XB; 8/62; 8/15; 8/25; 8/82; 8/73

[58] Field of Search ..... 8/1 XB, 62, 65, 15, 8/82, 18 A, 25, 73

[56] References Cited

U.S. PATENT DOCUMENTS

| | | | |
|---|---|---|---|
| 398,564 | 2/1889 | Williams | 8/82 |
| 1,951,571 | 3/1934 | Fischer et al. | 8/62 |
| 1,976,679 | 10/1934 | Fikentscher et al. | 8/92 |
| 2,533,635 | 12/1950 | Seymour | 8/18 A |
| 2,726,133 | 12/1955 | Helfenberger et al. | 8/15 |
| 2,895,785 | 7/1959 | Alsberg et al. | 8/65 |
| 3,090,762 | 5/1963 | Maeder et al. | 8/18 A |
| 3,449,057 | 10/1969 | Ward | 8/15 |
| 3,512,913 | 5/1970 | Day et al. | 8/4 |
| 3,647,507 | 3/1972 | Ashcraft | 8/18 A |
| 3,707,351 | 12/1972 | Mecco | 8/15 |
| 3,743,477 | 7/1973 | Egli | 8/15 |

FOREIGN PATENT DOCUMENTS

| | | | |
|---|---|---|---|
| 45-01677 | 2/1970 | Japan | 8/15 |
| 47-23712 | 1/1972 | Japan | 8/65 |
| 829443 | 2/1960 | United Kingdom | 8/65 |
| 871193 | 6/1961 | United Kingdom | 8/18A |
| 1350291 | 4/1974 | United Kingdom . | |

OTHER PUBLICATIONS

Shah, N. C. *Silk and Rayon Industries of India,* Vol. 12(5), pp. 265–286.

Knecht, E. The Principles—Practice of Textile Printing, Charles Griffin and Co. Ltd., London, 1952, pp. 1036–1037.

Dupont Technical Info. D262, p. 7, 1972 and D278, pp. 8–11, 1974.

*Primary Examiner*—Donald E. Czasa
*Assistant Examiner*—Maria S. Tungol
*Attorney, Agent, or Firm*—Gerald D. Sharkin; Richard E. Vila; Thomas C. Doyle

[57] ABSTRACT

Disclosed is a process for dyeing or printing a textile substrate employing an aqueous paste comprising dyestuff and a synthetic thickener, which process comprises the step of applying an electrolyte to the substrate prior to or after application of said aqueous paste, said paste being free from added electrolyte.

19 Claims, No Drawings

DYEING AND PRINTING WITH SYNTHETIC THICKENERS

The invention relates to a dyeing or printing process for textile substrates.

Thus, the invention provides a process for dyeing or printing a textile substrate employing an aqueous paste comprising dyestuff and a synthetic thickener, which process comprises the step of applying an electrolyte to the substrate prior to or after application of said aqueous paste, said paste being free from added electrolyte.

Whilst the process is suitable for the dyeing or printing of a wide variety of textile substrates, it has particular application in the dyeing and printing of pile and tufted fabrics and floor coverings, particularly pile and tufted carpets.

The aqueous paste comprising dyestuff and a synthetic thickener, hereinafter called "the dye paste", may be applied to the substrate in conventional manner, e.g. over the whole surface thereof or over discrete areas thereof to obtain a desired pattern, e.g. using screen, rotary film, rotary relief, spray (e.g. "militron" technique) and drop (e.g. "Tak" technique) methods. Indeed, a combination of said methods may be employed, for example by applying a first colour dye paste over the entire surface, followed shortly thereafter by one or more different coloured further dye pastes over selected, optionally overlapping, areas of the substrate, to obtain multi-colour effects.

The electrolyte is generally applied from a paste or liquor, generally over the whole area of the substrate and, if desired, any paste or liquor from which the electrolyte is applied may contain dyestuff, e.g. to give a ground colour to a pattern formed by the dye in the dye paste. When in liquor form, it may be applied using such conventional techniques as, e.g., dye padder or slop padding devices, by mechanical or electrostatic spraying, and, when in paste form, by printing techniques, e.g. employing a fully engraved rotary printing screen.

Where the electrolyte is applied in paste or liquor form prior to application of the dye paste, the pick-up thereof is preferably caused to lie in the range of 50% to 500%, more preferably below 100%, by weight, particularly where a liquor is employed, based on the weight of the substrate, e.g. by controlling the pick-up or by carrying out an intermediate drying step prior to application of the dye paste. Indeed, provided the electrolyte remains on the substrate, complete intermediate drying of the substrate may be carried out.

The nature of the electrolyte, for the reasons given hereinafter, is essentially immaterial to the invention and it may, for example, be an acid, a base or a salt. Where, however, the dyestuff in the dye-paste is of a class for which fixation is preferably carried out with the aid of an acid, the electrolyte preferably comprises or consists of an acid or an acid yielding salt, i.e. a salt which produces an acid under the dyeing or finishing conditions. As examples of preferred acids may be given acetic, formic and citric acids, and of preferred acid yielding salts may be given ammonium sulphate and tartrate. As examples of other salts which may be used as or comprised in the electrolyte may be given common salt and Glauber's salt.

The nature, e.g. class, of dyestuff employed in the dye paste, as will be appreciated, is chosen depending on the chemical nature of the textile substrate to be dyed or printed. Thus, where the substrate comprises or consists of natural or synthetic polyamide, the dye used will generally be an anionic dye, a reactive dye or a disperse dye. Where the substrate comprises or consists of acid modified polyacrylonitrile, the dye will generally be a metal complex dye, a basic dye or a disperse dye: where basic modified polypropylene, the dye will generally be an anionic or metal complex dye: where nickel modified polypropylene, the dye will generally be a disperse dye: where polyester, the dye will generally be a disperse dye; where acid modified polyester, the dye will generally be a cationic dye; where basic modified polyester, the dye will generally be an anionic dye: and where cotton, the dye will generally be a direct or reactive dye. As will be appreciated, two or more classes of dyestuff may be comprised in the dyestuff paste where the substrate comprises fibres dyeable with two or more different classes of dye, e.g. a disperse dye may be used together with an anionic dye where the substrate is of natural or synthetic polyamide. Two or more different classes of dyes may likewise be used when dyeing fibre blends. Any dye employed, however, of a class normally containing electrolyte, is preferably low in electrolyte content, i.e. in standardising salts and salts employed in salting out the dyestuff during production. Any residual salt of this nature of not intended to be embraced by the term "added electrolyte" as used herein, such term being reserved for electrolytes intentionally added to the dye paste. By "low in electrolyte content" is meant dyestuffs which contain less than about 30 or 40% of salts based on the weight of pure dyestuff.

The dye paste, and any paste or liquor from which the electrolyte is applied, may contain additional conventional dyeing or printing additives, of which antifrost and antifoaming agents are preferred, especially when dyeing or printing carpets. The dye paste should not, however, have added thereto any dyeing or printing assistant or additive which is an electrolyte, such assistant or additive, where it is required, being comprised in, or employed as, the electrolyte. In addition to the synthetic thickener, the print paste may, if desired, comprise a natural thickener, e.g. of the type hereinafter given.

Hitherto, difficulties have arisen with the use of synthetic thickneres when used in processes involving electrolytes, because of the sensitivity of the former to the latter. These difficulties, in the past, have generally been overcome either by not using electrolytes when using synthetic thickeners or by using natural thickeners in place of the synthetic thickeners. The former method, i.e. avoidance of electrolytes, is not very satisfactory when dyes which are preferably fixed under acid conditions are employed, since the lack of any acid or acid yielding salt means that full fixation of the dyestuff cannot generally be achieved. The latter method, i.e. the use of natural thickeners in place of synthetic thickeners, means that the many advantages of the latter over the former, such as generally higher dyestuff fixation rate, purity and uniformity of product, and easier and quicker paste formation, are lost and, because natural thickeners have a higher solids content, difficulties of washing residual thickener from the finished substrate can arise.

By the present invention, of course, since the electrolyte is applied separately from any synthetic thickener in the print paste, the above difficulties have been overcome. Not only that, but the disadvantage of sensitivity of synthetic thickeners to electrolytes has been turned to advantage, which advantage is general to the use of all classes of dyes, not only to the use of those preferably applied in the presence of acids. Thus, in the present invention, once a dye paste containing a synthetic thickener comes into contact, on the substrate, with the electrolyte, whether such is applied prior or subsequent to the dye paste, the viscosity of the print paste, because of the sensitivity of the synthetic thickening agent therein to electrolytes, falls considerably. This means that the dyestuff in the dye paste can, because it is applied as a paste, be applied conveniently and accurately in the desired locations so as to obtain sharply defined prints, but that, once the paste liquefies on contact with the electrolyte, the dyestuff is carried into the structure of the substrate, thereby achieving good penetration, a factor of particular importance, of course, in the dyeing and printing of pile and tufted fabrics, especially pile and tufted carpets. Moreover, the degree of drop in viscosity, and hence degree of penetration, can, to some extent, be controlled by varying the amount of electrolyte applied. In the case of dyes preferably applied under acid conditions, additional electrolyte, e.g. common salt or Glauber's salt, over and above the amount of acid or acid yielding salt needed merely as fixation agent, may be included for a particularly drastic drop in viscosity. Further, by including in the print paste, additional to the synthetic thickener, an amount of natural thickener, much less sensitive to electrolytes, a predetermined base level, to which the viscosity of the print paste can fall, can be established depending on the amount of natural thickener, thereby controlling the degree of penetration independent of the amount of electrolyte added.

As will be appreciated, the synthetic thickening agents used in the present invention are those which are sensitive to, and lose their thickening properties on contact with, electrolytes. Indeed, however, all the synthetic thickening agents currently available to and used by the dryer and printer are of this type. They are generally mixtures of long chain polymers which contain neutralised acid groups, such as those described as carboxylated acrylate polymers, carboxylated vinyl polymers and ethylene maleic anhydride polymers.

The exact make-up of the dye paste is not critical. The preferred pastes, however, have a viscosity of about 1,0000–30,000 cps, when applied to the substrate, as measured on a Haake Viskotester VT-02, spindle diameter 24 mm, spindle height 53 mm, at 62.5 r.p.m. at room temperature. Of course, ranges within this viscosity range will be chosen depending on the desired method of application. Where synthetic thickeners are used, the paste is advantageously thixotropic, thereby enabling easy application of the paste.

The composition and concentration of any liquor or paste from which the electrolyte is applied can vary within wide limits depending, for example, as described above, on the desired end viscosity of the print paste and the desired print-through or penetration of the substrate. The nature of the substrate, e.g. density and height of pile, and the initial viscosity of the print paste, also play a role, as does the characteristic of the dye in the dye paste, i.e. the electrolyte will preferably comprise an acid or an acid yielding salt when dyes are used which are preferably fixed under acid conditions. Also, the make-up of the electrolyte, i.e. its form, will depend on the desired method of application thereof, e.g. it will be in paste form when applied by printing technqies and in liquor form when applied by padding or spraying techniques. Where a dye is applied with the electrolyte and/or the electrolyte is applied as a paste, a binder or thickener, suitably a natural thickener, such as a carob bean, locust bean and guar derivatives or an alginate is generally included.

The above advantages of the present invention, e.g. the ability to print accurately the substrate using a paste and the subsequent fall in viscosity of the paste to achieve penetration, are not the only advantages. Thus, as will be appreciated, since the electrolyte is applied separate from the print paste, not only is the electrolyte kept from the thickener until on the substrate, it is also kept from the dyestuff. Many dyestuffs, particularly of the basic and anionic dyestuff classes, are sensitive to electrolytes. By separation of the electrolyte from the dye a fuller range of dyes may be employed, i.e. including known electrolyte sensitive dyes, without fear of gelling or salting out in the dye paste.

After carrying out the process of the invention, completion of dyeing, e.g. involving fixation, washing and drying steps takes place in known manner. However, since synthetic thickeners are used in the dye paste, since such have very low solid content and since good fixation takes place, the amount of washing required is considerably reduced and, in many cases, may be omitted altogether.

In a preferred embodiment of the invention the substrate is of natural or synthetic polyamide, the dyestuff employed is an anionic dye or mixture of anionic dyes, optionally with a disperse dye, and the electrolyte is applied as a paste or liquor containing an acid or acid yielding salt, optionally together with a neutral salt such as Glauber's salt or common salt.

The invention is further illustrated by the following Examples, in which all parts and percentages are by weight and all temperatures in degrees centigrade.

EXAMPLE 1

A polyamide-66-tufted carpet having a weight of 600 g/m$^2$ is impregnated with a padding liquor (I), consisting of

| | |
|---|---|
| 20 | parts of crystalline ammonium sulphate (acid yielding salt) |
| 10 | parts of iso-octylphenol-poly(4-5) glycol ether (anti-frost agent) |
| 970 | parts of water |
| 1000 | parts |

on a two-roller dye padder, and it is squeezed out to an 80% increase in dry weight. Subsequently, a printing paste (II) consisting of

| | |
|---|---|
| 5 | parts of the dyestuff C.I. Acid Red 151 |
| 4 | parts of polymethacrylate thickener (commercially available) |
| 991 | parts of water |
| 1000 | parts |

the pH of which has been adjusted to about 7 by addition of —$NH_4OH$ to neutralise the polymethacrylate and confer the thickening properties thereon, is printed on continuously by a flat screen. Then it is fixed for 10 minutes in saturated steam at 102° and the carpet washed with cold water.

A vivid red pattern is obtained. No gelling of the dye paste is observed and good penetration of the carpet tufts is achieved.

EXAMPLE 2

A polyamide-6-tufted carpet with a weight of 600 g/m$^2$ is impregnated as in Example 1 with a padding liquor (I) consisting of

| | |
|---|---|
| 20 | parts of crystalline ammonium sulphate |
| 980 | parts of water |
| 1000 | parts |

and is subsequently continuously printed with a printing paste (II) consisting of

| | |
|---|---|
| 10 | parts of the dyestuff C.I. Acid Yellow 127 |
| 10 | parts of iso-octylphenol-poly(4-5) glycol ether |
| 2 | parts of anti-foaming agent based on mineral oil |
| 4 | parts of polymethacrylate thickener (commercial) |
| 974 | parts of water |
| 1000 | parts |

the pH of which has been adjusted to about 7 by addition of —$NH_4OH$ to neutralise the polymethacrylate and confer the thickening properties thereon, using a rotary printing screen. Further treatment effected as in Example 1.

A brilliant yellow pattern is obtained. No precipitation of the dyestuff occurs in the paste and good penetration of the carpet tufts is achieved.

EXAMPLE 3

A needle-felt carpet with a dyeable proportion of polyamide-6 is printed with a printing paste consisting of (I)

| | |
|---|---|
| 5 | parts of the dyestuff C.I. Acid Blue 278 |
| 4 | parts of polymethacrylate thickener (commercial) |
| 991 | parts of water |
| 1000 | parts |

the pH value of which has been standarised at about 7 with —$NH_4OH$ to neutralise the polymethacrylate and confer thickening properties thereon. It is printed using a rotary printing screen and is subsequently sprayed, to a take-up of 50% by weight, based on the dry weight of the goods, with a liquor consisting of (II)

| | |
|---|---|
| 50 | parts of crystalline ammonium sulphate |
| 30 | parts of iso-octylphenol-poly(4-5) glycol ether |
| 920 | parts of water |
| 1000 | parts. |

Penetration is increased by means of a squeezing roller. The carpet is treated for 5 minutes in saturated steam at 102° C. and the process continues as in Example 1. A high yield of fixation is achieved in relatively short fixation time.

EXAMPLE 4

A polyamide-66-tufted velvet material with a weight of 700 g/m$^2$ is impregnated with a solution (I) as in Example 2, and is subsequently continuously printed with a printing paste (II) consisting of

| | |
|---|---|
| 10 | parts of the dyestuff C.I. Acid Red 263 |
| 10 | parts of iso-octylphenol-poly(4-5) glycol ether |
| 2 | parts of anti-foaming agent based on mineral oil |
| 4 | parts of polymethacrylate thickener (commercial) |
| 974 | parts |
| 1000 | parts |

The pH value is set at about 7 with $NH_4OH$. It is printed by a flat printing screen and the material is finished as described in Example 1.

A brilliant red pattern is obtained and an increased degree of fixation is achieved. The washing liquids are only slightly coloured. A considerably shorter washing process is therefore sufficient.

EXAMPLE 5

A polyamide-6-tufted loop material with a weight of 666 g/m$^2$ is impregnated with a padding liquor (I) consisting of

| | |
|---|---|
| 20 | parts of crystalline ammonium sulphate |
| 5 | parts of carob bean flour ether |
| 10 | parts of iso-octylphenol-poly(4-5) glycol ether |
| 965 | parts of water |
| 1000 | parts |

on a two-roller dye padder (to 100% dry weight increase).

Subsequently, a dyeing paste (II), consisting of

| | |
|---|---|
| 3 | parts of the dyestuff C.I. Acid Yellow 151 |
| 4 | parts of polymethacrylate thickener (commercial) |
| 993 | parts of water |
| 1000 | parts |

which is set at a pH value of about 7 with $NH_4OH$, is printed on continuously by a fully engraved rotary printing screen. It is fixed for 10 minutes in saturated steam at 102° and then washed with cold water and dried.

A carpet dyed in golden yellow-brown is obtained. The particularly good through-colouring of the high pile is most noticeable.

EXAMPLE 6

In the absence of a coating apparatus which runs synchronously with the printing aggregate, the process is as follows:

Impregnation is effected as given in Example 5, but the goods are then dried. They are subsequently printed in a separate stage with the dyeing paste (II) described in Example 5, using a fully engraved rotary printing screen and a hydroslot doctor.

A yellow-brown carpet is obtained, with equally good results as in Example 5.

EXAMPLE 7

A polyamide-66-tufted loop material with a weight of 500 g/m$^2$ is printed with a dyeing paste (I) consisting of

| | |
|---|---|
| 8 | parts of the dyestuff C.I. Acid Orange 67 |
| 4 | parts of polymethacrylate thickener (commercial) |
| 988 | parts of water |

-continued

| | |
|---|---|
| 1000 | parts |

set to a pH of 7 by addition of $NH_4OH$, by means of a fully engraved rotary printing screen and a magnetic roller-doctor system (at 250% dry weight increase).

Subsequently, a liquor consisting of (II)

| | |
|---|---|
| 20 | parts of crystalline ammonium sulphate |
| 10 | parts of iso-octylphenol-poly(4-5) glycol ether |
| 5 | parts of carob bean flour ether |
| 965 | parts of water |
| 1000 | parts |

is applied continuously over the entire width of the material by means of a suitable applicator, and it is further treated as described in Example 1. A brilliant orange-dyed carpet is obtained with excellent colour penetration of the pile.

EXAMPLE 8

A polyamide-6-tufted velvet of 600 g/m$^2$ is impregnated with a dye liquor (I), consisting of

| | |
|---|---|
| 2 | parts of the dyestuff C.I. Acid Yellow 151 |
| 8 | parts of carob bean flour ether |
| 20 | parts of crystalline ammonium sulphate |
| 5 | parts of iso-octylphenol-poly(4-5)glycol ether |
| 2 | parts of anti-foaming agent based on mineral oil |
| 963 | parts of water |
| 1000 | parts |

on a two-roller dye padder (to 100% dry weight increase).

Subsequently, a printing paste (II) consisting of

| | |
|---|---|
| 5 | parts of the dyestuff C.I. Acid Red 119 |
| 4 | parts of ethylene-maleic acid anhydride copolymer (commercial) |
| 10 | parts of iso-octylphenol-poly(4-5) glycol ether |
| 2 | parts of anti-foaming agent based on mineral oil |
| 979 | parts of water |
| 1000 | parts |

is printed on continuously by means of a relief printing roller, and it is further treated as described in Example 1. In a shortened fixation time, a bordeaux print is obtained on a golden-yellow background with a high yield of fixation.

EXAMPLE 9

A polyamide-66-tufted loop fabric of 450 g/m$^2$ is printed with a printing paste (I), consisting of

| | |
|---|---|
| 6 | parts of the dyestuff C.I. Acid Red 151 |
| 4 | parts of polymethacrylate thickener (commercial) |
| 10 | parts of iso-octylphenol-poly(4-5)glycol ether |
| 2 | prts of anti-foaming agent based on mineral oil |
| 978 | parts of water |
| 1000 | parts |

set to a pH of 7 by addition of $NH_4OH$, by means of a rotary printing screen. Subsequently, it is over-printed continuously with a dye paste consisting of

| | |
|---|---|
| 1 | part of the dyestuff C.I. Acid Yellow 127 |
| 16 | parts of carob bean flour ether |
| 20 | parts of crystalline ammonium sulphate |
| 5 | parts of iso-octylphenol-poly(4-5)glycol ether |
| 2 | parts of anti-foaming agent based on mineral oil |
| 956 | parts of water |
| 1000 | parts |

by means of a fully engraved rotary printing screen (at 200% dry weight increase), and it is further treated as described in Example 1. A brilliant red print is obtained on a yellow background.

EXAMPLE 10

A polyester tufted velvet fabric having a weight of 750 g/m$^2$ is impregnated to a take-up of 60%, based on the dry weight thereof, by spraying with a liquor consisting of

| | |
|---|---|
| 80 | parts Glauber's salt (crystals) and |
| 920 | parts of water |
| 1000 | parts |

and then continuously printed, employing a rotary printing screen with a paste consisting of

| | |
|---|---|
| 30 | parts dyestuff C.I. Disperse Yellow 42 |
| 5 | parts iso-octylphenol-poly(4,5) glycol ether |
| 5 | parts anti-foaming agent (mineral oil based) |
| 6 | parts polymethacrylate thickener (commercial) |
| 954 | parts of water |
| 1000 | parts |

the pH of which has been adjusted to 7 by addition of —$NH_4OH$. Fixation takes place in saturated steam at 102° C. over 10 minutes, whereafter the material is washed with cold water and dried. A yellow print is obtained with especially good dye penetration of the thick pile.

EXAMPLE 11

A polyester shag carpet is impregnated as described in Example 10 and then, without intermediate drying, employing the so-called "TAK" technique a paste is applied of the following composition,

| | |
|---|---|
| 20 | parts dyestuff C.I. Disperse Orange 30 |
| 5 | parts iso-octylphenol-poly(4,5) glycol ether |
| 5 | parts anti-foaming agent (mineral oil based) |
| 2 | parts polymethacrylate thickener (commercial) and |
| 968 | parts of water |
| 1000 | parts |

the pH of which has been adjusted to about 7 by addition of —$NH_4OH$. The carpet is treated in saturated steam at 102° for 10 minutes to effect fixation and then washed with cold water and dried.

An orange pattern effect is obtained with deep penetration of the dyestuff.

EXAMPLE 12

A velvet carpet material of acid modified polyacrylonitrile, is impregnated as described in Example 10 and then continuously printed, employing a flat bed printing screen with a paste of the following composition,

| | |
|---|---|
| 5 | parts dyestuff C.I. Basic Blue 41 |
| 5 | parts iso-octylphenol-poly(4,5) glycol ether |
| 5 | parts anti-foaming agent (mineral oil based) |
| 6 | parts polymethacrylate thickener (commercial) and |
| 979 | parts of water |
| 1000 | parts |

the pH of which has been adjusted to about 7 with —$NH_4OH$.

Fixation is carried out in saturated steam at 102° C. over 10 minutes, followed by washing with cold water and drying. A bright blue pattern, with good print-through, is obtained.

What is claimed is:

1. In a process wherein a pile or tufted textile fabric is dyed or printed by applying thereto an aqueous dye paste comprising a dyestuff and a synthetic thickener which is sensitive to electrolytes, the improvement which comprises employing such a dye paste which is free from added electrolyte and applying an electrolyte to those portions of the substrate which are to be dyed or printed with said dyestuff, prior to or after application of said dye paste and before fixation of the dyestuff, and causing contact between said electrolyte and said dye paste, whereby there occurs a reduction in the viscosity of said dye paste with resulting improved penetration and dyeing or printing of those portions of the substrate where said contact occurs.

2. A process according to claim 1 wherein the electrolyte is applied to the whole area of the substrate.

3. A process according to claim 1 wherein the synthetic thickener is a mixture of long chain polymers which contain neutralized acid groups.

4. The process of claim 1, wherein an anti-frost or anti-foam agent or mixture of such agents is contained in the paste containing the dyestuff and synthetic thickener or in any liquor or paste containing the electrolyte or in both the paste containing the dyestuff and synthetic thickener and the liquor or paste containing the electrolyte.

5. The process of claim 1, wherein the electrolyte is applied from a liquor or paste.

6. The process of claim 5, wherein the electrolyte-containing liquor or paste is applied prior to application of the paste comprising dyestuff and synthetic thickener.

7. The process of claim 6, wherein the pick-up of the electrolyte-containing paste or liquor is from 50% to 500% based on the dry weight of the substrate.

8. The process of claim 7, wherein the electrolyte is applied from a liquor, the pick-up of said liquor being less than 100% based on the dry weight of the substrate.

9. The process of claim 5, wherein the electrolyte-containing liquor or paste is applied after application of the paste comprising dyestuff and thickener.

10. The process of claim 1 wherein the dyestuff in the dye paste is an acid fixable dyestuff, the electrolyte comprising an acid or an acid-yielding salt.

11. The process of claim 10, wherein the substrate is of natural or synthetic polyamide, the dyestuff employed is an anionic dye and the electrolyte is applied as a liquor or paste and comprises an acid or an acid-yielding salt.

12. The process of claim 10, wherein, additional to the acid or acid-yielding salt, the electrolyte comprises a neutral salt.

13. The process of claim 10, wherein said acid is acetic, formic or citric acid and said acid-yielding salt is ammonium sulphate or tartrate.

14. The process of claim 12, wherein said neutral salt is Glauber's salt or common salt.

15. The process of claim 1, wherein a dyestuff is applied along with the electrolyte.

16. The process of claim 1, wherein the viscosity of the paste containing dyestuff and synthetic thickener, as applied to the substrate, is from 1,000 to 30,000 c.p.s. as measured on a Haake Viskotester VT-02, spindle diameter 24 mm, spindle height 53 mm, at 62.5 r.p.m. at room temperature.

17. The process accoring to claim 16 wherein any dye employed which normally contains standarizing salt or salt employed in salting out during its production contains less than 30% of such salt based on the weight of pure dyestuff.

18. A printing process according to claim 17 wherein the paste containing the dyestuff and synthetic thickener is thixatropic and the thickener is selected from the group consisting of carboxylated acrylate polymers, carboxylated vinyl polymers and ethylene maleic anhydride polymers.

19. The process of claim 1, wherein the paste containing the dyestuff and synthetic thickener is thixotropic.

* * * * *